United States Patent [19]

Mainka

[11] 4,111,134

[45] Sep. 5, 1978

[54] BEARING ASSEMBLY FOR A STOKER CARRIAGE

[75] Inventor: Christian M. Mainka, New York, N.Y.

[73] Assignee: Morse Boulger, Inc., New York, N.Y.

[21] Appl. No.: 734,760

[22] Filed: Oct. 22, 1976

[51] Int. Cl.[2] ..... F23B 1/20; F23B 1/22

[52] U.S. Cl. ..... 110/328; 308/3 R

[58] Field of Search ..... 110/38; 126/174; 308/3 R

[56] References Cited

U.S. PATENT DOCUMENTS

| | | | |
|---|---|---|---|
| 2,806,439 | 9/1957 | Wagner | 110/38 |
| 3,126,846 | 3/1964 | Wagner | 110/38 |
| 3,585,947 | 6/1971 | Dvirka | 110/38 |

*Primary Examiner*—Kenneth W. Sprague

*Attorney, Agent, or Firm*—Mason, Fenwick & Lawrence

[57] ABSTRACT

A reciprocating bearing assembly is disclosed for supporting a stoker grate carriage in a reciprocating stoker of the type having a stoker grate housing, a plurality of stationary and movable grates and a drive mechanism to reciprocate the grate carriage and movable grates of the stoker to provide a stoking action, the bearing assembly including a stub shaft fixed to the stoker housing, a bearing member journaled on the shaft with means for permitting limited angular and axial movement of the bearing member with respect to the shaft, and a downwardly opening guideway mounted on the grate carriage and engageable with a bearing surface on the bearing member to permit reciprocation of the guideway with respect to the bearing surface of the bearing member.

14 Claims, 4 Drawing Figures

3
3
14
12
18
78
86
85
80
84
70
72
68
64
60
58
40
42
46
50
76
82
74
44
56

BEARING ASSEMBLY FOR A STOKER CARRIAGE

This invention relates to bearing assemblies and more particularly to a reciprocating bearing assembly which is self-adjusting, self-cleaning and long-lasting.

The presently known reciprocating stokers with movable grates, such as those used in refuse incineration systems, having been provided with bearing assemblies with flat bearing surfaces, which are subject to the accumulation of fly ash deposits and unequal wear. An accelerating unevenness of wear occurs in the present assemblies and ultimately results in distortion of the motion of the movable grates in the reciprocating stokers. These bearing assemblies are positioned below the movable grates in order to maintain the bearings at a sufficiently low temperature to prevent warping and oxidation of the wear surfaces. Positioning the bearings below the grates, where fly ash and various forms of abrasive debris filters down from the combustion area, creates extremely high rates of wear on the bearing surfaces. Since the presently known bearing assemblies have not been self-adjusting, the high wear rates are accelerated by the abrasive, high temperature environment. High wear increases the actuation forces required from the drive mechanisms which reciprocate the stoker grates. Without self-adjusting bearings, the presently known reciprocating stoker grate assemblies have experienced increased cost of maintenance and loss of operating time of the stoker assembly, caused by frequent manual alignment of the bearings which is necessary to maintain smooth operation of the stoker assembly. The short life expectancy of the previously known reciprocating stoker bearing assemblies is a distinct disadvantage as a long period of time is required in cooling an incinerator or the like to a sufficiently low temperature to permit necessary repairs, adjustments or replacement of the bearing assemblies.

Accordingly, it is the principal object of the present invention to provide a novel reciprocating bearing assembly.

Another object of the present invention is to provide a reciprocating bearing assembly which is self-cleaning and capable of preventing an accumulation of fly ash deposits on the bearing surfaces.

A further object of the present invention is to provide a reciprocating bearing assembly which is self-adjusting to compensate for temperature fluctuations and normal wear of the bearing surfaces.

A still further object of the present invention is to provide a novel reciprocating bearing assembly which reduces the rate of wear of the bearing surfaces thus preventing distortion of the motion of the grates and binding of carriages.

Another object of the present invention is to provide a novel reciprocating bearing assembly which reduces maintenance costs and down time of reciprocating stokers.

An additional object of the present invention is to provide a novel reciprocating bearing assembly which is permanently lubricated and self-adjusting to further increase the useful life of the bearing assembly and permit uninterrupted operation.

A still further object of the present invention is to provide a novel reciprocating bearing assembly which is easily maintained and capable of operating within the severe environment of a stoker such as the type used in a refuse incinerator.

Other objects and advantages of the present invention will become more apparent to those persons having ordinary skill in the art to which the invention pertains, from the following description taken in conjunction with the accompanying drawings, wherein.

Figure 1:
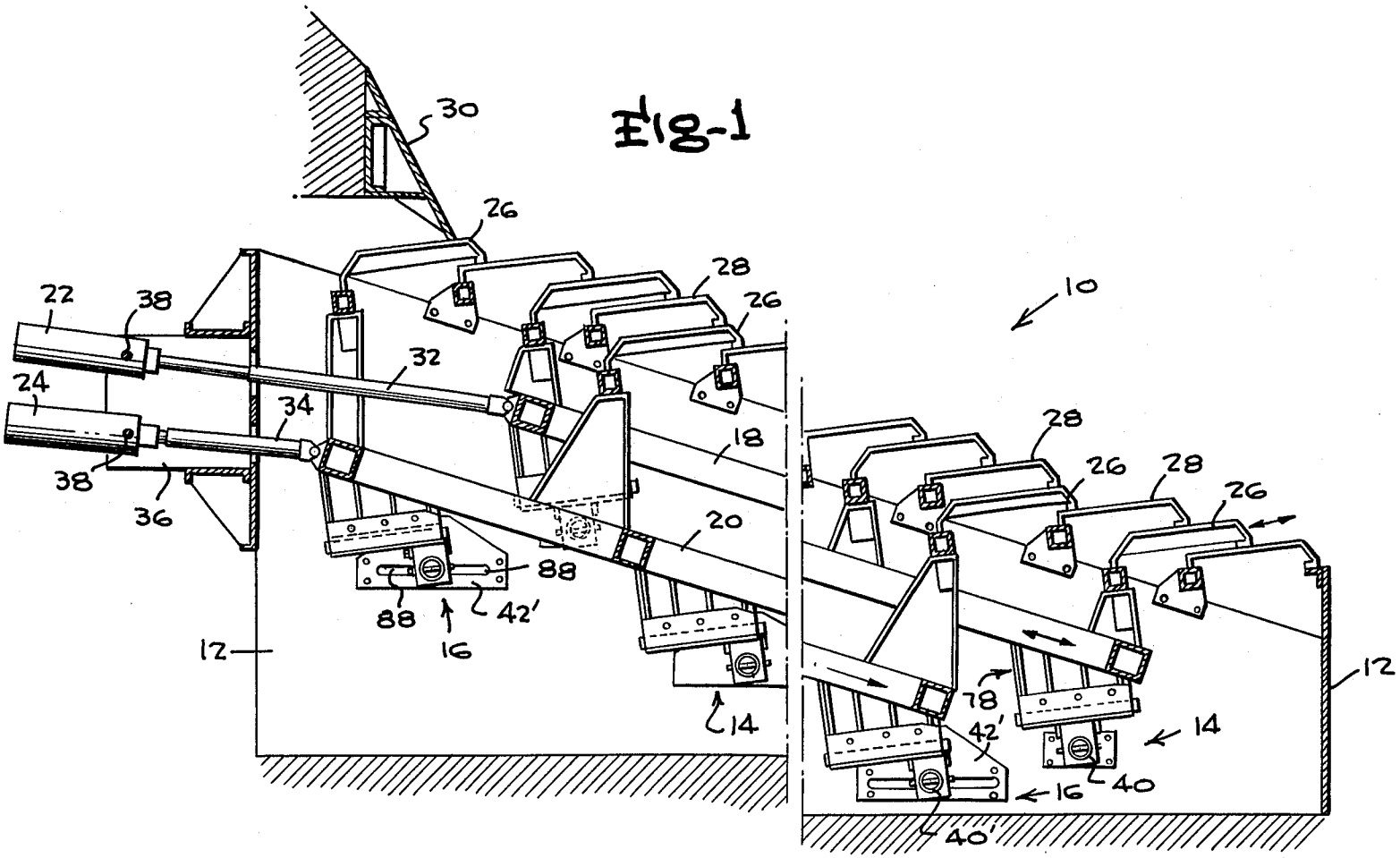
FIG. 1 is a fragmentary side elevational view of a reciprocating stoker utilizing the present invention.

Referring to FIG. 1, there is illustrated a reciprocating stoker on which the present invention may be utilized. The reciprocating stoker, generally indicated with reference numeral 10, includes a stoker housing 12 formed of sheet metal with bearing assemblies 14 and lower bearing assemblies 16 mounted on the stoker housing. An upper grate carriage 18 and a lower grate carriage 20 are supported on the bearing assemblies and reciprocate, as indicated in FIG. 1, when driven by upper and lower hydraulic cylinders 22 and 24. Movement of the upper and lower grate carriages 18 and 20 cause movable grates 26 to translate relative to fixed grates 28 as indicated in FIG. 1. Fixed grates 28 are attached to the stoker housing 12 as shown in FIG. 1.

Refuse, coal or the like is introduced down a chute 30 to the stoker 10 and is moved from left to right, as viewed in FIG. 1, through suitable actuation of the upper and lower hydraulic cylinders 22 and 24. The hydraulic cylinders are connected to the upper and lower grate carriages 18 and 20 by piston rods 32 and 34, pivotally connected to the carriages at the forward ends of the piston rods. The hydraulic cylinders are retained by suitable pivots 38 to a support bracket 36 mounted on the housing 12 as indicated in FIG. 1. Actuation of the hydraulic cylinders 22 and 24 causes the movable grates 26 to move as indicated in FIG. 1 which provides a stoking action to tumble the refuse or fuel along the length of the stoker. Combustion air is provided from beneath and/or above the stoker to burn the refuse or fuel with the stoking action producing complete combustion of the materials fed to the stoker.

Figures 2, 3:
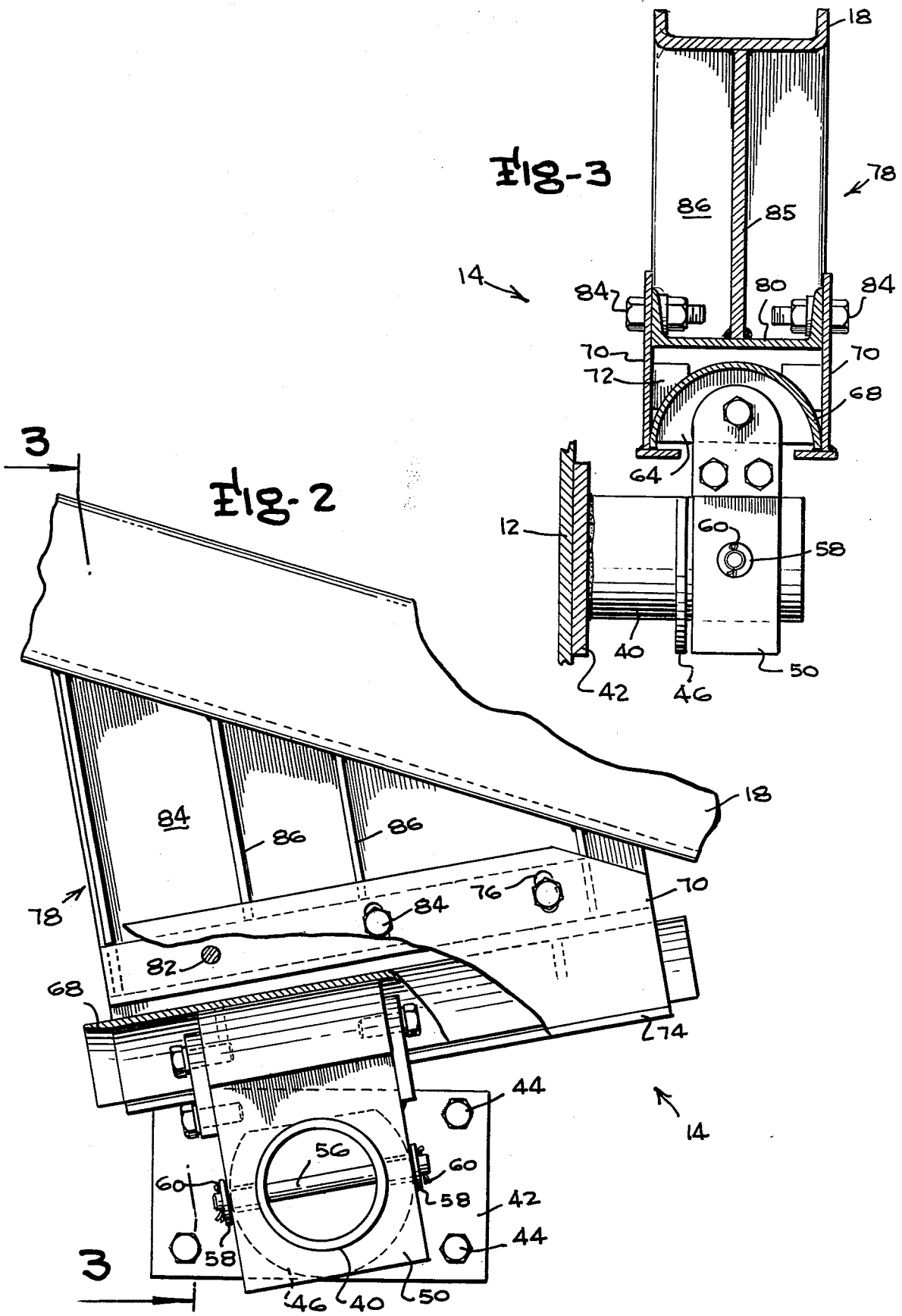
FIG. 2 is a side elevation view of a preferred embodiment of the present invention attached to a portion of a stoker housing.
FIG. 3 is a fragmentary cross-sectional view of the bearing assembly taken along line 3—3 in FIG. 2.
Figure 4:
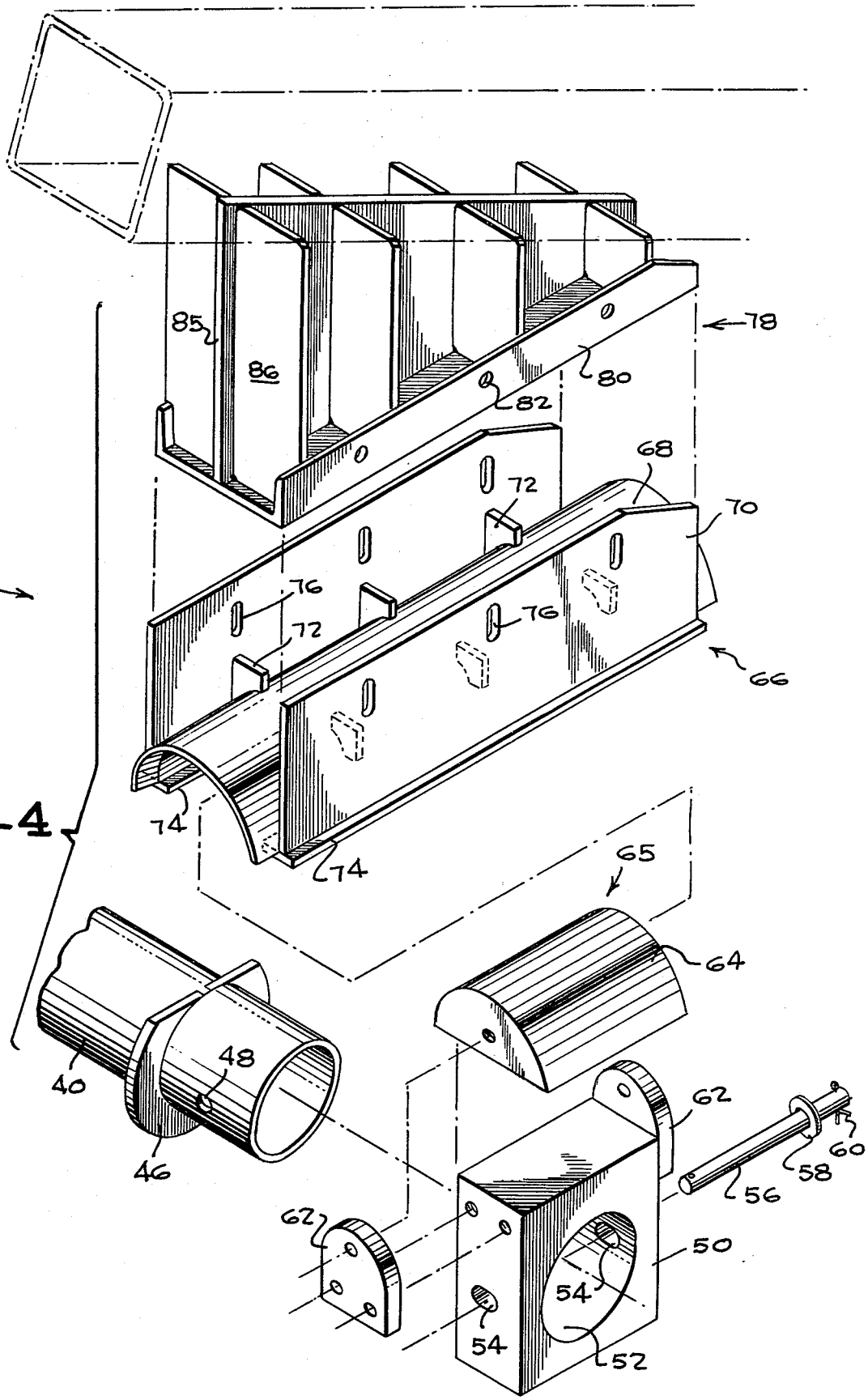
FIG. 4 is an exploded perspective view of the embodiment illustrated in FIGS. 2 and 3.

The bearing assembly 14 according to the present invention, as shown in detail in FIGS. 2, 3 and 4, includes a stub shaft 40 attached to the stoker housing 12 by a rectangular mounting plate 42 welded to one end of the stub shaft and bolted to the stoker housing 12 by mounting bolts 44. A retaining collar 46 is positioned centrally on the shaft and a limiting hole 48 passing through the stub shaft 40 between the retaining collar 46 and the free end of the stub shaft. An upper portion of the retaining collar 46 may be removed, as indicated in FIGS. 3 and 4, to provide clearance between the various parts.

A bearing block 40 of rectangular shape has a bearing bore 52 passing through the center thereof. The inside diameter of the bearing bore 52 is slightly larger than the diameter of the stub shaft which permits sliding the bearing block onto the free end of the stub shaft to a position adjacent the retaining collar 46, as shown in FIG. 3. Clearance slots 54, opening into the bearing bore 52, are alignable with the limiting hole 48 on the stub shaft to receive a retaining pin 56 which passes through the hole 48 and slots 54. The retaining pin 56 is held in the bearing block by washers 58 and cotter pins 60 positioned at the ends of the retaining pin 56, as shown in FIG. 2.

Two retaining plates 62 are bolted to opposite sides of the bearing block 50 with the retaining plates extending above the upper surface of the bearing block to receive a semi-cylindrical wearing member 64 which is bolted therebetween. The semi-cylindrical surface 65 of the wearing member 64 is positioned upwardly to form a bearing surface to support the upper grate carriage 18 with the axis of the semi-cylindrical surface 65 oriented in a direction perpendicular to the axis of the stub shaft 40. The wearing member 64 may be formed of bronze or a suitable low-friction bearing material which is capable of operating within an incinerator or the like.

An upper guideway assembly 66, as shown in FIG. 4, includes a semi-circular guideway 68 which opens downwardly and has an inside diameter approximately equal to the outside diameter of the wearing member 64. The guideway 68 is formed of a suitable sheet material such as steel which is harder than the semi-cylindrical surface 65 of the wearing member 64 which it contacts. Two support plates 70 are welded to the edges of the guideway and extend parallel and upwardly from the edges of the guideway to permit the guideway to open downwardly and be seated on the wearing member 64, as shown in FIG. 3. The guideway 68 is reinforced by gussets 72 which extend outwardly from the side plates 70 and contact the guideway. The support plates 70 have a plurality of spaced apart and parallel slot bolt holes 76 along the upper edge of each of the support plates.

Two guide plates 74, welded to the lower edges of the support plates 70 and the guideway 68, extend inwardly to prevent the guideway 68 from leaving the bearing surface 65 of the wearing member 64 after the guideway has been slid onto the wearing member to the desired position as indicated in FIG. 2.

A mounting assembly 78 is welded to the upper grate carriage 18, as shown in FIGS. 2 and 3, and includes an upwardly opening channel 80 having bolt holes 82 registrable with the slotted bolt holes 76 in the support plates 70, as shown in FIGS. 2 and 4. Mounting bolts 84 are positioned in the bolt holes 82 and the slotted bolt holes 76 to permit initial alignment of the upper grate carriage 18 with respect to the stoker housing 12 which permits proper interaction of the movable grates 26 with the stationary grates 28. Loads are transmitted from the channel 80 to the upper grate carriage 18 by a longitudinal, centrally positioned reinforcing plate 85 and lateral stiffening ribs 86 which are welded along one edge to the reinforcing plate 85 and to the channel 80 respectively. This configuration provides a rigid mounting assembly for retaining the guideway 68 in the desired position.

The lower bearing assemblies 16, which are similar to the upper bearing assemblies 14, have a longer stub shaft 40', as suggested by FIG. 1, and a larger mounting plate 42' to permit the addition of reinforcing struts 88. This configuration permits the lower grate carriage 20 to support the movable grates 26 without interfering with the operation of the upper grate carriage 18.

The bearing assembly 14 is easily installed by first bolting the mounting plate 42 to the stoker housing 12 as suggested in FIGS. 2 and 3. The bearing bore 52 of the bearing block 50 is slid over the stub shaft 40 to a position adjacent the retaining collar 46. The limiting hole 48 on the stub shaft 40 is aligned with the clearance slots 54 in the bearing block 50. The retaining pin 56 is then inserted through the hole and slots and washer 58 and cotter pin 60 are mounted on the retaining pin as shown in FIG. 2.

This configuration provides a limited degree of freedom for axial movement and rotation about the stub shaft to create the desired self-aligning characteristic of the assembly.

The wearing assembly 64 is bolted into position between the retaining plates 62 with the wearing member 64 extending beyond the sides of the bearing block 50. The guideway assembly 66 is slid over the wearing member 64 with the guide plates 74 extending below the wearing member 64 to retain the guideway 68 on the wearing member. The grate carriage with integral mounting assembly 78 is lowered into position with the channel bolt holes 82 on the channel 80 aligned with the slotted bolt holes 76 in the support plates 70 to permit insertion and tightening of the bolts 84. With the holes 82 and 76 in alignment, the bolts 84 lock the guideway 68 in the desired positioned relative to the grate carriage 18.

As can be seen from the simplicity of the bearing assembly, it is a simple matter to replace and align wearing member 64 through removal of one of the retaining plates 62 and insertion of a new wearing member. Likewise, the guideway assemblies 66 may be removed by unfastening bolts 84 and inserting a new guideway assembly as necessary.

During operation of the stoker, fly ash and debris will filter down through the grates. With the bearing assemblies as provided by the present invention, these foreign materials will be prevented from accumulating on the wearing surfaces by the downwardly opening guideway 68 and the self-cleaning action of the wearing member 64 provided by the edges of the wearing member 64 as the wearing member moves along the wearing surface of the guideway 68. The contacting surfaces may be provided with a permanent lubrication to minimize friction and reduce wear.

From the foregoing detailed description, it will be evident that there are a number of changes, adaptations and modifications of the present example which come within the province of those skilled in the art. It is intended, however, that all such variations not departing from the spirit of the invention be considered as within the scope thereof and limited solely by the appended claims.

I claim:

1. A reciprocating bearing assembly capable of operating in an abrasive environment wherein a plurality of said assemblies support a structure for reciprocating movement, said bearing assembly comprising a fixed shaft, bearing means journaled on the shaft, means for permitting limited angular and axial movement of the bearing means with respect to the shaft, a downwardly opening guideway, wear surface means mounted on said bearing means and engageable with said guideway for permitting reciprocation of said guideway with respect to said wear surface means.

2. The reciprocating bearing assembly of claim 1 wherein the wear surface means includes a semi-cylindrical bearing member and wherein said guideway includes a semi-cylindrical bearing surface engageable with said semi-cylindrical bearing member to permit reciprocation of said guideway with respect to said semi-cylindrical bearing member.

3. The reciprocating bearing assembly of claim 2 wherein the semi-cylindrical bearing member includes scraping means on the semi-cylindrical bearing member for cleaning the guideway as the guideway reciprocates relative to the bearing member.

4. The reciprocating bearing assembly of claim 3 wherein said scraping means includes an end surface on said bearing member intersecting the semi-cylindrical surface thereby providing a scraping edge to remove accumulated materials from the guideway as the bearing means moves along the guideway.

5. The reciprocating bearing assembly of claim 1 wherein said wear surface means is shorter than said guideway thereby permitting reciprocation of said guideway with respect to said wear surface means without exposing said wear surface means to said abrasive environment.

6. The reciprocating bearing assembly of claim 1 wherein the means for permitting limited angular and axial movement of the bearing means with respect to the shaft includes a hole through the shaft generally perpendicular to the axis of the shaft, slots in the bearing means registrable with said hole through said shaft and a retaining pin passing through said hole and said slots, said retaining pin being smaller in diameter than the width of the slots to thereby permit limited angular and axial movement of the bearing means with respect to the shaft.

7. The reciprocating bearing assembly of claim 2 wherein said guideway includes inwardly directing lips which are engageable with a flat side of said semi-cylindrical bearing member to prevent separation of the guideway from the semi-cylindrical bearing member during operation of the stoker assembly.

8. A reciprocating stoker assembly for operation in an incinerator or the like, said assembly including a stoker grate housing, a plurality of stationary grates mounted on the housing, a stoker grate carriage, a plurality of movable grates mounted on said stoker grate carriage and extending between said stationary grates, a drive mechanism for reciprocating said grate carriage, a plurality of shafts mounted on said stoker housing with the axis of the shaft generally perpendicular to the desired line of movement of said grate carriage, a bearing means journaled on each of said shafts, means for permitting limited angular and axial movement of the bearing means with respect to the shaft, a downwardly opening guideway mounted on said grate carriage, wear surface means mounted on said bearing means and engageable with said guideway for permitting reciprocation of said guideway with respect to said wear surface means.

9. The stoker grate assembly of claim 8 wherein the wear surface means include a semi-cylindrical bearing member and wherein said guideway includes a semi-cylindrical bearing surface engageable with the semi-cylindrical bearing member to permit reciprocation of said guideway with respect to said bearing member.

10. The stoker assembly of claim 9 wherein the semi-cylindrical bearing member includes scraping means on the semi-cylindrical bearing member for cleaning the guideway as the guideway reciprocates relative to the bearing member.

11. The stoker assembly of claim 10 wherein said scraping means includes an end surface on said bearing member intersecting the semi-cylindrical surface thereby providing a scraping edge to remove accumulated materials from the guideway as the bearing means moves along the guideway.

12. The stoker assembly of claim 8 wherein said wear surface means is shorter than said guideway thereby permitting reciprocation of said guideway with respect to said wear surface means without exposing said wear surface means to said abrasive environment.

13. The stoker assembly of claim 8 wherein the means for permitting limited angular and axial movement of the bearing means with respect to the shaft includes a hole through the shaft generally perpendicular to the axis of the shaft, slots in the bearing means registrable with said hole through said shaft and a retaining pin passing through said hole and said slots, said retaining pin being smaller in diameter than the width of the slots to thereby permit limited angular and axial movement of the bearing means with respect to the shaft.

14. The stoker assembly of claim 9 wherein said guideway includes inwardly directing lips which are engageable with a flat side of said semi-cylindrical bearing member to prevent separation of the guideway from the semi-cylindrical bearing member during operation of the stoker assembly.

* * * * *